United States Patent [19]

Fabiny et al.

[11] Patent Number: 4,634,609

[45] Date of Patent: Jan. 6, 1987

[54] PROCESS AND APPARATUS FOR COATING

[75] Inventors: Eugene S. Fabiny, Pittsburgh; George W. Hessler, Sewickley; John H. Bradel, Jr., Baden, all of Pa.

[73] Assignee: Hussey Copper, Ltd., Leetsdale, Pa.

[21] Appl. No.: 746,035

[22] Filed: Jun. 18, 1985

[51] Int. Cl.[4] ..... B05C 3/12; B05C 19/02; B05D 1/18; B05D 1/40

[52] U.S. Cl. ..... 427/345; 118/419; 118/428; 118/429; 427/433; 427/434.2; 427/434.5

[58] Field of Search ..... 427/431, 433, 434.2, 427/434.5, 434.6, 345; 118/419, 420, 428, 429

[56] References Cited

U.S. PATENT DOCUMENTS

| | | | |
|---|---|---|---|
| 59,599 | 11/1866 | Hazelton | 427/433 |
| 645,520 | 3/1900 | Braddock | 427/433 X |
| 789,690 | 5/1905 | Goodson | 427/431 X |
| 1,558,035 | 10/1925 | Millring | 118/422 |
| 2,046,036 | 6/1936 | Rodriguez | 118/422 X |
| 2,095,718 | 10/1937 | Simmons | 427/433 |
| 2,286,745 | 6/1942 | Liebhafsky | 427/433 X |
| 2,325,126 | 7/1943 | Giesler | 427/431 X |
| 2,325,156 | 7/1943 | Whitfield | 427/431 |
| 2,525,603 | 10/1950 | Jenks et al. | 118/428 X |
| 2,586,142 | 2/1952 | Bailey et al. | 427/433 |
| 2,702,525 | 2/1955 | Whitfield | 118/420 |
| 2,806,445 | 9/1957 | Lawrence | 118/69 |
| 3,082,119 | 3/1963 | Harris | 427/434.2 X |
| 3,649,510 | 3/1972 | Smith et al. | 118/602 X |
| 3,711,320 | 1/1973 | Byrd et al. | 427/431 X |
| 3,819,406 | 6/1974 | Tachimori et al. | 427/433 |
| 4,275,098 | 6/1981 | Gunji et al. | 118/419 X |
| 4,317,845 | 3/1982 | Karasawa et al. | 118/419 X |

FOREIGN PATENT DOCUMENTS

| | | | |
|---|---|---|---|
| 224335 | 7/1910 | Fed. Rep. of Germany | 427/431 |
| 126640 | 3/1978 | Japan | 427/431 |
| 87764 | 1/1921 | Switzerland | 427/431 |

*Primary Examiner*—Michael R. Lusignan
*Attorney, Agent, or Firm*—John F. Witherspoon

[57] ABSTRACT

The present invention pertains to a method for coating metallic sheets which involves controlling the surface characteristics of the molten coating material in the area that the metal sheet enters and leaves so that the effect of contaminants on the coating operation will be minimized. The invention also pertains to an apparatus for carrying out this method.

5 Claims, 5 Drawing Figures

COOLING WATER
C
S

PROCESS AND APPARATUS FOR COATING

This invention pertains to a method and apparatus for coating metallic sheets with a liquid coating material and more particularly to a coating method and apparatus which minimizes surface defects on the coated sheet due to contaminants contained in the liquid coating material.

A known method for coating a metallic sheet involves introducing the metallic sheet into a reservoir of a molten coating material (usually a molten metal) and keeping the metallic sheet immersed therein until the molten coating material has effected a bond to the surfaces of the metallic sheet. After that the coated metallic sheet is removed from the reservoir, cooled and dried. In this known process it has been found that the coated metallic sheet may contain imperfections and impurities on its surface, and these imperfections have been attributed to the fact that the surface of the molten coating material includes various undesirable residuals or contaminants floating thereon that interfere with the bonding step, or with the surface of the coated sheet as it is removed from the reservoir of coating material. One contaminant that may collect or be formed on the surface of the molten coating material is dross. Dross is undesirable because it adheres to the surface of the metal sheet to be coated, has no use as a byproduct, is often toxic and uses up coating material that would otherwise be bonded to the metal sheet.

An object of this invention is to provide a process and apparatus wherein a metallic sheet is coated by passing it through a molten bath in such a way that the occurrence of defects on the surface of the metal sheet is reduced or eliminated. Another object is to provide a method and apparatus which will permit the continuous coating of coiled metal sheets of considerable length.

An understanding of the invention may be obtained by reference to the attached drawings wherein.

Figures 1, 4, 5:
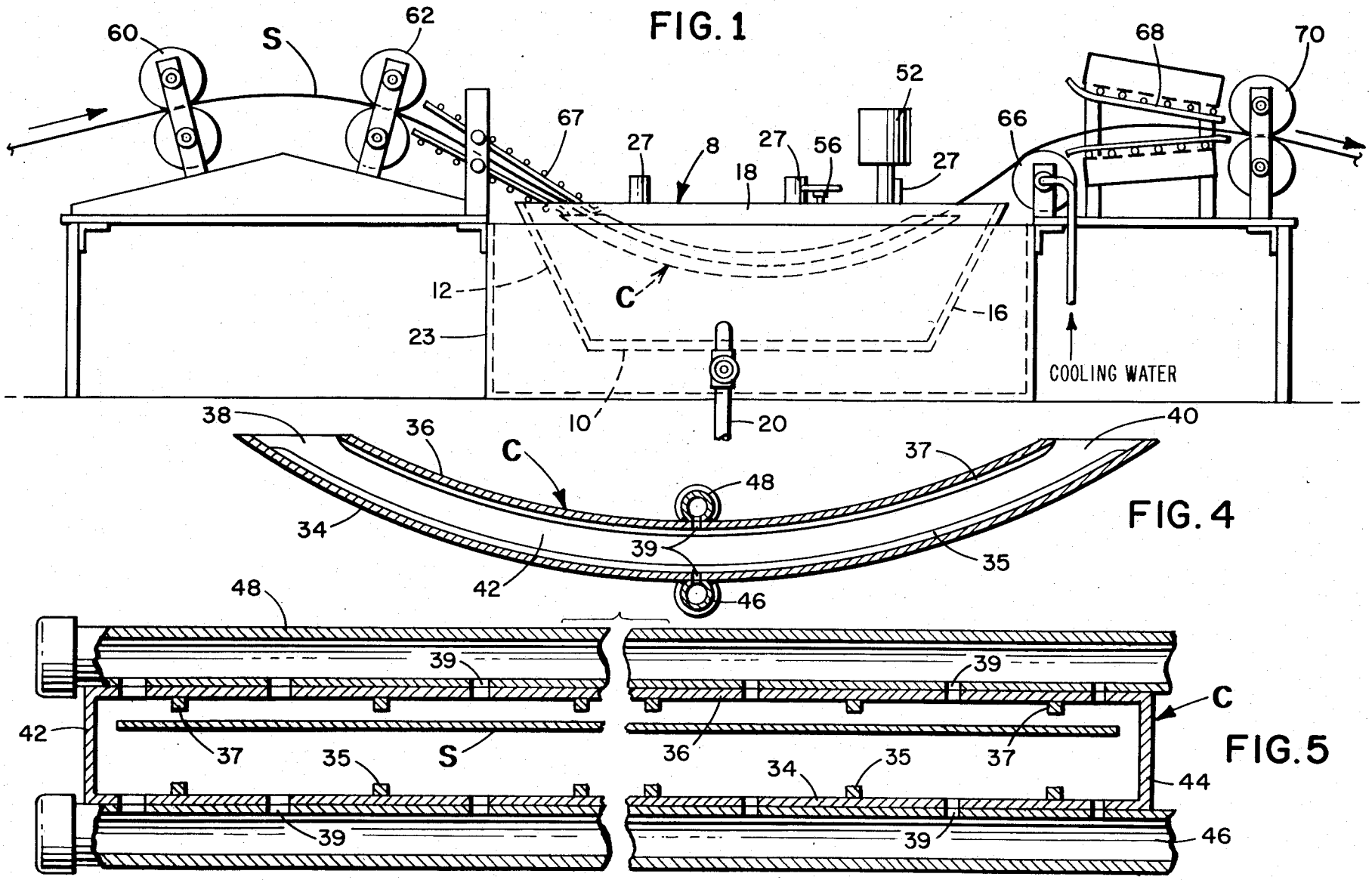
FIG. 1 is a side elevation of one embodiment of the invention with certain parts in section.
FIG. 4 is a longitudinal sectional view along 4—4 of FIG. 2.
FIG. 5 is a transverse sectional view along 5—5 of FIG. 2.
Figure 2:
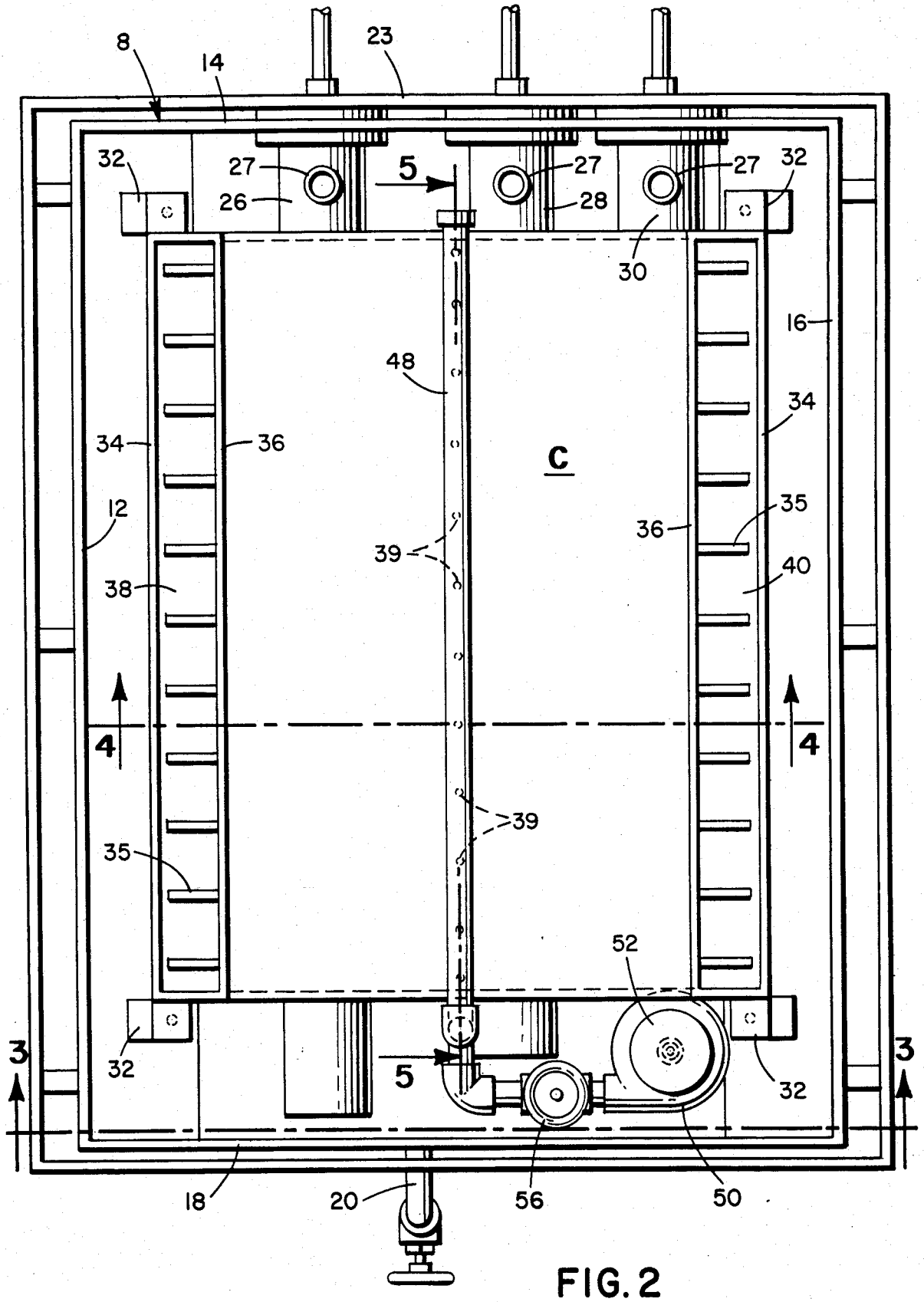
FIG. 2 is a top plan view of the tank and coating chamber shown in FIG. 1.
Figure 3:
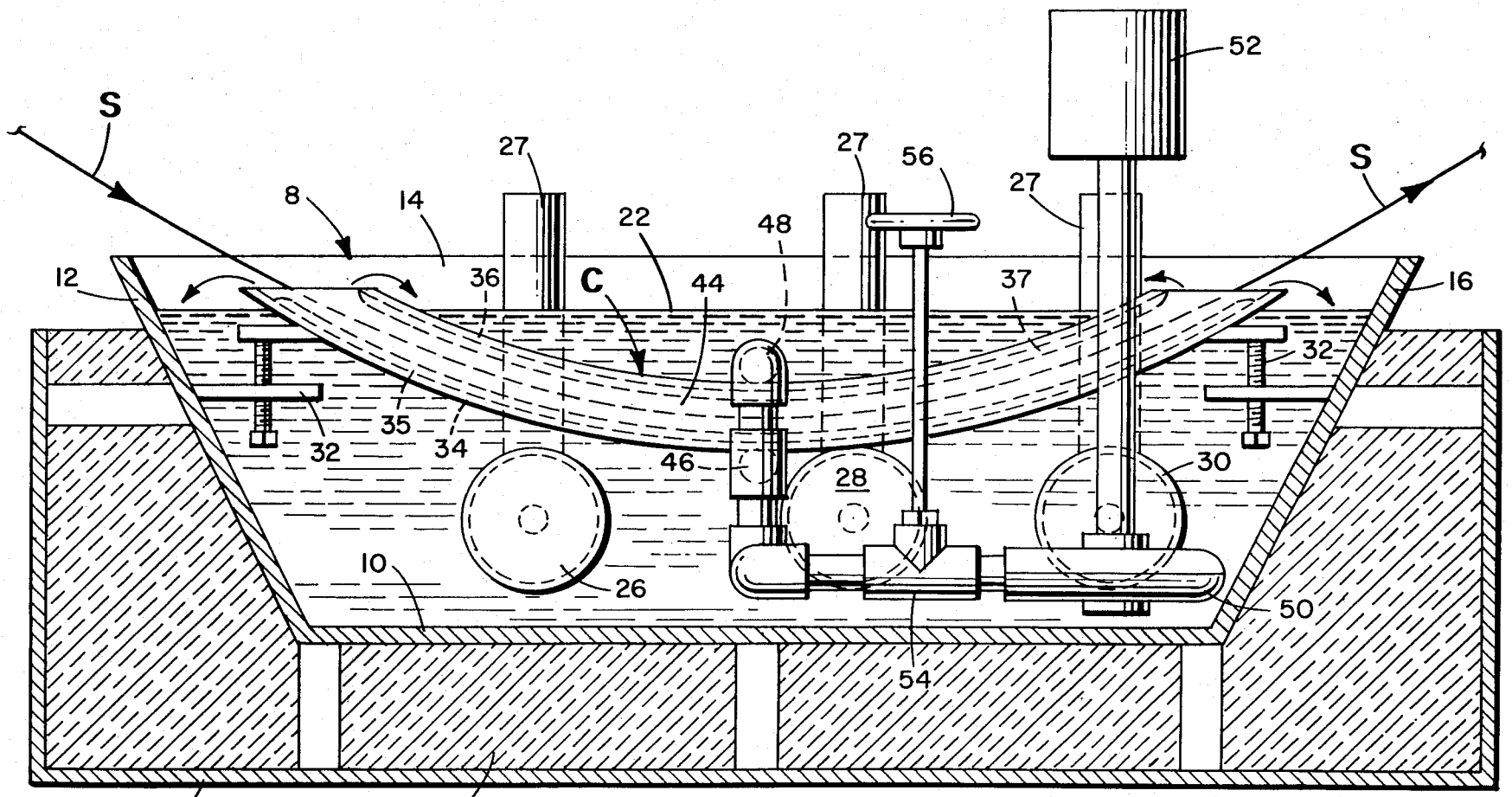
FIG. 3 is a longitudinal sectional view along 3—3 of FIG. 2.

Referring now to the drawings, a tank 8 for holding a supply of molten metallic coating material is seen to consist of a bottom 10 and side sections 12, 14 16 and 18. The molten material in the tank can be drained by means of valved conduit 20. The upper level of the molten coating material in the tank is indicated by 22. Tank 8 is preferably surrounded by a housing 23 containing insulating material 24 that minimizes heat losses from the bottom and sides of the tank 8. The coating material is maintained in a molten condition in tank 8 by heating means, such as gas fired heaters 26, 28 and 30 that extend through the tank a short distance above the bottom 10 and which can be vented through exhaust stacks 27.

A coating chamber or zone C is supported within the perimeter of the tank 8 by a plurality of support members 32. These support members are preferably vertically adjustable so that the outlet ends of the coating chamber can be raised or lowered as desired. It will be seen that the coating chamber C comprises two spaced apart, upwardly concave and generally arcuate wall sections 34 and 36 that define between them a restricted flow path for molten coating material. Two outlets 38 and 40 for molten coating material are located at the opposite open ends of said spaced apart wall sections 34 and 36, and in the embodiment shown in the drawings the outlets 38 and 40 are each generally rectangular in configuration and disposed in a plane parallel to the bottom 10 of the tank 8. The wall sections 34 and 36 are maintained in a spaced apart relationship with respect to each other by being welded to end plates 42 and 44.

The coating zone C is provided with inlets for molten coating material, said inlets being located intermediate the aforesaid outlets 38 and 40 and at a lower level than said outlets so that the introduced molten coating material will diverge outwardly in two different directions when introduced and flow upwardly toward the spaced apart outlets 38 and 40. In the embodiment shown in the drawings two inlets are shown, a lower inlet manifold 46 that discharges into the lower portion of the coating chamber against the underside of a metal sheet S passing through the coating chamber and an upper inlet manifold 48 that discharges into the upper portion of the coating chamber against the upperside of a sheet passing therethrough. Inlet manifolds 46 and 48 are preferably located outside the coating chamber and discharge into the coating chamber by means of a plurality of small orifices 39 distributed across the width of the coating chamber, the diameters of the orifices increasing in size from the front to the back of each manifold to insure even distribution of the coating medium within the coating chamber.

The inlet manifolds 46 and 48 are shown as being connected to a pump means 50 that has a suction side which will pick up the molten coating material from the tank 8 and force it under pressure through the inlet manifolds 46 and 48 so that the molten coating material introduced into the coating chamber C will diverge outwardly and upwardly to outlets 38 and 40. The molten coating material exiting at outlets 38 and 40 will not remain there but will instead cascade downwardly into the reservoir of molten coating material in tank 8 because the fluid surface level in outlets 38 and 40 is always maintained at a higher elevation than the surface level 22 of the fluid in tank 8. Any contaminants that do develop in the coating zone will therefore not float on the liquid surface at outlets 38 and 40 but will be rapidly carried away in a cascading overflow to the lower reservoir in tank 8. This difference in surface levels between outlets 38 and 40 and the reservoir in tank 8 can be maintained by any suitable type of liquid level control means associated with tank 8 (such as a weir or overflow pipe) or by controlling the total amount of molten coating material or by regulation of the output of pump 50 or by support members 32. A motor 52 is shown driving pump 50 and the volume of flow of fluid from the pump 50 to the inlet manifolds 46 and 48 can be controlled by a valve means 54 that can be manipulated by a wheel or handle means 56 extending upwardly from the valve 54.

The coating chamber C preferably contains guide means within its interior to guide a sheet of material therethrough so that there is little or no contact between the sides of the metal sheet and the spaced apart sides 34 and 36 of the coating chamber. In the embodiment shown in the drawings guide means 35 are shown on the bottom wall 34 and guide means 37 are shown on the upper wall 36, the guide means consisting of a plurality of laterally spaced apart ridge-like members that follow the curvature of the walls 34 and 36 from a point near one outlet end of the coating chamber to a point near the other outlet end of the coating chamber. Such guide means not only effectively prevent actual contact between sheets passing through the coating chamber and the walls 34 and 36 of the coating chamber, but also insure continuous flow of the molten coating medium along both the upper and lower sides of a sheet passing through the coating chamber. Without these guides there is the possibility that the sheet S could press up against the orifices 39 of the inlet manifolds and at least partially block the flow of molten coating material therethrough.

When a sheet of metal is to be coated in accordance with this invention it is fed forwardly by pinch rolls 60 and 62 and through an adjustable guide mechanism 64 to insure correct entry of the sheet material into one of the outlets (e.g. 38) of the coating chamber. Once in the coating chamber the sheet follows the generally arcuate contour of the coating chamber and emerges from the other outlet of the coating chamber ( e.g. 40), whereafter it passes over a first exit roll 66 (preferably water-cooled), through an exit guide mechanism 68 and then through exit pinch rolls 70.

The present invention eliminates or at least minimizes attachment of contaminants such as dross to the surface of the metal sheet passing through the coating chamber, since any dross formed or contained in the molten coating material within the coating chamber C will not remain as a floating mass at oulets 38 and 40 but will instead flow rapidly away from outlets 38 and 40 and cascade downwardly into the reservoir. The fluid surface of outlets 38 and 40 thus remain essentially free of contaminants that could adversely affect the coating operation.

Our invention is particularly useful for coating copper sheets with molten lead. However, the general principles of the invention are also applicable to other metallic sheets such as iron, steel and aluminum and other molten coating material such as zinc. The invention is particularly useful for the continuous coating of rolls of sheet metal. For example, sheet copper in a continuous coil can be fed from a pay-out reel through a heated flux bath to clean both sides of the copper and facilitate a good bond between the copper sheet and lead coating that is to be applied. From the flux bath the copper sheet is mechanically fed through the in-feed pinch rolls and the in-feed guide mechanism into the coating chamber. A lead coating medium containing ninety-six percent lead and four percent tin is heated and maintained at a flowing temperature of approximately 720° F. by means of three natural gas heating tubes in the reservoir. The molten lead is pumped into the coating zone through the top and bottom manifolds 46 and 48 via an 80 gpm pump. The molten lead enters the coating zone through a plurality of orifices in the manifolds 46 and 48, such orifices being sized to even the flow of the molten lead across the width of the coating chamber. The molten lead flows around both sides of the copper sheet in the coating zone and exits from the outlets 38 and 40, cascading back into the reservoir and thereby preventing the buildup of dross in these two outlet areas due to rapid lateral surface movement of the lead coating medium. As a result, the copper sheet enters into and exits from dross-free liquid lead. The continuous sheet then proceeds over a water cooled exit roll and through the exit guiding mechanism, where it is air cooled prior to passing through the exit pinch rolls and continuing through the roller conveyor where it is further cooled. The sheet then passes through a roller leveler and on to the take-up reel where it is put back in coil form.

What is claimed is:

1. A process for applying a metallic coating material to the surface of a metallic sheet which comprises:

(a) establishing a coating zone that is composed of two separate streams of molten coating liquid that diverge outwardly and upwardly in two different directions from an incoming supply of molten coating liquid, (b) discharging said separate diverging streams of molten coating liquid in the form of two spaced apart liquid overflow zones, (c) introducing the sheet to be coated downwardly through one of said two overflow zone countercurrently to one of said diverging streams of molten coating liquid and withdrawing the coated sheet upwardly through the other of said overflow zones concurrently with the other of said diverging streams of molten coating liquid, (d) recovering the molten coating liquid from said overflow zones by collecting it in a reservoir having a liquid surface that is located at a level lower than the liquid surface of said overflow zones, (e) continuously removing a portion of the molten coating liquid in said reservoir and introducing it into said coating zone at a point intermediate said two spaced overflow zones, and (f) controlling the flow of molten coating liquid through said coating zone so that contaminants contained in said molten coating liquid will be continuously and rapidly displaced from the surfaces of said overflow zones into said reservoir below said overflow zones, thus minimizing the opportunity for the contaminants to adhere to the sheet as it passes through said two overflow zones.

2. A process according to claim 1 wherein the metallic sheet is copper and the molten coating material is lead or a combination of lead and tin.

3. An apparatus for applying a metallic coating to the surface of a metallic sheet which comprises (a) a tank for holding a supply of molten coating material and heating means for maintaining said coating material in a molten condition, (b) a coating chamber supported within the perimeter of said tank, said chamber comprising (1) two spaced apart, upwardly concave and generally arcuate wall sections that provide therebetween a restricted flow path for molten coating material, (2) two outlets for molten coating material located at opposite ends of said spaced apart wall sections, (3) inlets for molten coating material, said inlets being located intermediate said outlets and at a lower level than said outlets, (c) pump means for pumping molten coating material from said tank to said inlets of said coating chamber, (d) means for maintaining the surface level of the molten coating material in said tank below the said two outlets of said coating chamber, and (e) transfer means for introducing a metallic sheet into one of said two outlets of said coating chamber and withdrawing it from the other of said two outlets.

4. An apparatus according to claim 3 wherein guide members are joined to each of said wall sections and extend toward the opposite wall section to thereby maintain introduced metal sheets a spaced distance away from said wall sections.

5. An apparatus according to claim 3 wherein said inlets comprise two elongated inlet manifolds that extend across the width of the coating chamber, said manifolds being positioned in facing relationship to each other so that one will be directed against the top of a sheet passing through the coating chamber and the other will be directed against the bottom of that same sheet.

* * * * *